US006612782B1

(12) United States Patent
Tengan

(10) Patent No.: US 6,612,782 B1
(45) Date of Patent: Sep. 2, 2003

(54) TELESCOPING TUBE AND METHOD FOR SUPPORTING SURROUNDING WALLS OF A SHAFT

(76) Inventor: James Tengan, 5121 Elkmont Dr., Rancho Palos Verdes, CA (US) 90275

( * ) Notice: Subject to any disclaimer, the term of this patent is extended or adjusted under 35 U.S.C. 154(b) by 0 days.

(21) Appl. No.: 10/122,925

(22) Filed: Apr. 12, 2002

(51) Int. Cl.[7] ..... E02D 23/00

(52) U.S. Cl. ..... 405/249; 405/251; 405/257; 405/294; 405/272; 182/195

(58) Field of Search ..... 405/133, 139, 405/140, 231, 232, 249, 251, 257, 294, 272; 182/78, 100, 195; 52/187; 248/354.1

(56) References Cited

U.S. PATENT DOCUMENTS 3,241,634 A * 3/1966 Prosser ..... 182/144
3,894,614 A * 7/1975 Naka ..... 182/100
3,958,376 A * 5/1976 Campbell ..... 52/115
4,124,987 A * 11/1978 Hallman et al. ..... 405/276
4,265,565 A * 5/1981 Stuckmann et al. ..... 405/145
5,015,125 A * 5/1991 Seegmiller ..... 405/288
5,333,422 A * 8/1994 Warren et al. ..... 52/115
5,850,713 A * 12/1998 Hojo ..... 52/118

FOREIGN PATENT DOCUMENTS

EP 997583 * 5/2000

* cited by examiner

*Primary Examiner*—Jong-Suk (James) Lee
(74) *Attorney, Agent, or Firm*—Goldstein & Lavas, P.C.

(57) ABSTRACT

A telescoping tube for supporting surrounding walls of a shaft during the rescue of a victim trapped at the bottom of the shaft. The tube has nesting interlocking successive sections, each successive section having a diameter smaller than the preceding section. Each section has a top edge and a bottom edge. A bottom rim oriented inward extends around the bottom edge perimeter of each section. A pair of top lips oriented outward extend outward from opposite quadrants of the perimeter of the top edge of each section. When the telescoping tube is extended downward, the top lips of the sections rest upon the bottom rim of the preceding sections. In order to collapse the tube, the sections are pulled upward into the preceding sections, thereby bringing the top lips of the sections into contact with the bottom rim of the preceding sections.

4 Claims, 3 Drawing Sheets

TELESCOPING TUBE AND METHOD FOR SUPPORTING SURROUNDING WALLS OF A SHAFT

BACKGROUND OF THE INVENTION

The invention relates to a telescoping tube for supporting surrounding walls of a shaft. In particular, the invention is a telescoping tube that is inserted into a shaft while attempting to rescue a victim trapped in the shaft, to support the surrounding environment from collapsing during the rescue attempt.

Emergency situations in which a person or animal is trapped at the bottom of a shaft, well, or cave require delicate handling of the structure in order to save the victim from injury. Because of the delicacy of the shaft, well or cave, the danger exists that surrounding walls of the structure might collapse before the victim can be rescued.

Thus, there exists a need for a device which may be inserted into the shaft and employed to support the surrounding walls of the shaft during a rescue attempt. Such a device should be collapsible for easy storage and extendable for insertion into a shaft.

While the units available may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved telescoping tube for supporting surrounding walls of a shaft. As such, the general purpose of the present invention, which will be described subsequently in greater detail, is to provide a new and improved telescoping tube for supporting surrounding walls of a shaft which has all the advantages of the prior art and none of the disadvantages.

To attain this, the present invention essentially comprises a telescoping tube for supporting surrounding walls of a shaft during the rescue of a victim trapped at the bottom of the shaft. The tube has nesting interlocking successive sections, each successive section having a diameter smaller than the preceding section. Each section has a top edge and a bottom edge. A bottom rim oriented inward extends around the bottom edge perimeter of each section. A pair of top lips oriented outward extend around opposite quadrants of the perimeter of the top edge of each section. When the telescoping tube is extended downward, the stop lips of the sections rest upon the bottom rim of the preceding sections. In order to collapse the tube, the sections are pulled upward into the preceding sections, thereby bringing the top lips of the sections into contact with the bottom rim of the preceding sections.

It is an object of the invention to produce a telescoping tube for supporting surrounding walls of a shaft which may be inserted into the opening of a shaft and extended downward to protect a trapped victim from injury due to the collapsing of the surrounding walls. Accordingly, the telescoping tube comprises a plurality of interlocking sections that are extending downward into a shaft which contains the victim.

It is a further object of the invention to produce a telescoping tube for supporting surrounding walls of a shaft wherein the tube is not susceptible to damage from contact with the dirt, mud or water. Accordingly, the tube is constructed from a lightweight rust resistant material. Such a material allows the tube to be kept in place during the course of the rescue attempt.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 2:
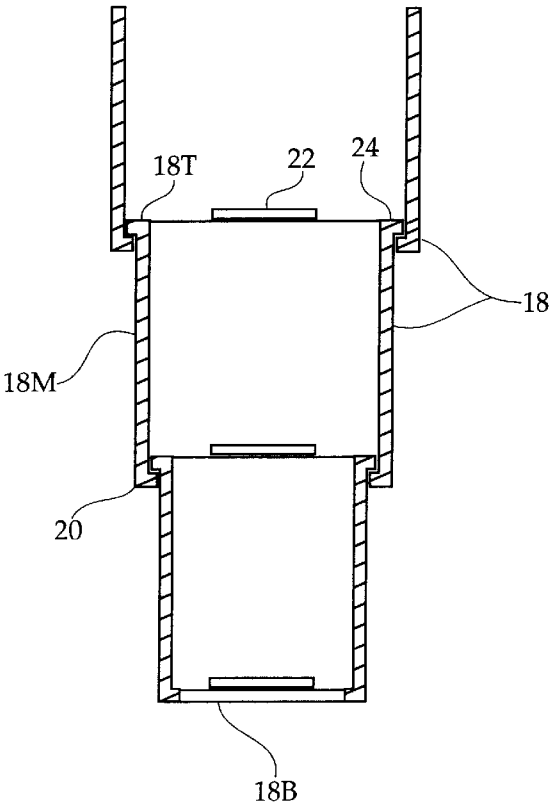
FIG. 2 is a side cross sectional view of a portion of the telescoping tube in an expanded position.

10 telescoping tube
12 shaft
12T opening of shaft
12B bottom surface of shaft
14 surrounding walls
16 victim
17 outer wall of section
18 section of telescoping tube
18T top edge of section
18B bottom edge of section
18M middle portion of section
19 bore
20 bottom rim
22 lower ledge
24 top lip
24N notch

DETAILED DESCRIPTION OF THE PREFERRED EMBODIMENTS

Figure 1:
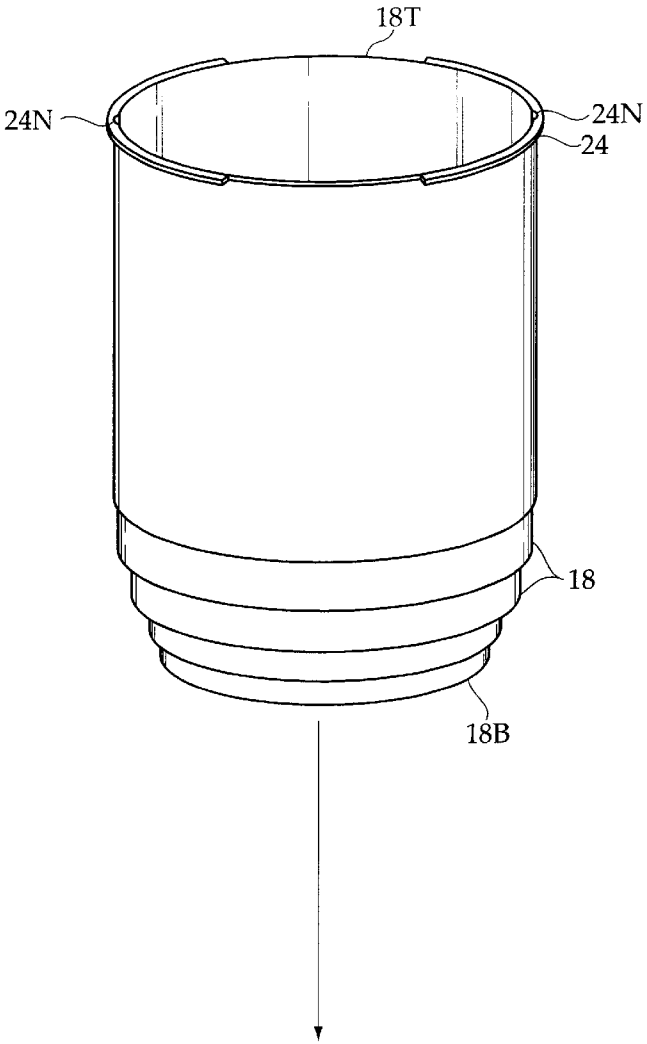
FIG. 1 is a perspective view of the telescoping tube in a collapsed state.

FIG. 1 illustrates a telescoping tube 10 for supporting surrounding walls 14 of a shaft 12, well or cave during the rescue of a victim trapped at the bottom of said shaft 12 or the like. The shaft 12 has a top opening 12T and a bottom surface 12B.

The telescoping tube 10 comprises a plurality of nested interlocking successive sections 18, each having an outer wall 17 having an outside diameter and a bore 19 defining an inner wall having an inside diameter, wherein each successive section 18 has a diameter smaller than the inside diameter of the preceding section 18. This construction allows the sections 18 to fit within each other when the tube 10 is collapsed for easy transport and storage.

Each section 18 is interlocking with the preceding section 18 to prevent separation of said sections 18 and inadvertent collapsing of the tube 10. Each section 18 has a top edge 18T, a bottom edge 18B, and a middle portion 18M extending therebetween. A narrow bottom rim 20 extends around the perimeter at the bottom edge 18B of each section 18, said bottom rim 20 oriented inward from the bore 19. A pair of lower ledges 22 extend inward just above the bottom rim 20 at two opposite quadrants. A pair of top lips 24 extend outward from the outer wall 17 around opposite quadrants of the perimeter of the top edge 18T of each section 18, said top lips 24 oriented outward. Each top lip 24 has a notch 24N therein. A pole may be selectively mated with the notches 24N in order to extend the sections 18, and rotate them axially. When mated with the bottom rim 20 of the preceding section 18, the top lips 24 serve as catches which prevent the sections 18 from being separated.

Thus, when the telescoping tube 10 is extended downward, the top lips 24 of the preceding section 18 will rest upon the bottom rim 20 of the successive section 18. This configuration will allow the sections 18 to fully extend outward from each other without separating therefrom. In order to collapse the tube 10, the sections 18 are pushed upward into the preceding sections 18.

The telescoping tube 10 is preferably constructed from lightweight, durable material, such as PVC. Such a material allows the tube 10 to maintain the integrity of the surrounding walls 14 of the shaft 12 without being subject to rust or corrosion.

Figure 3:
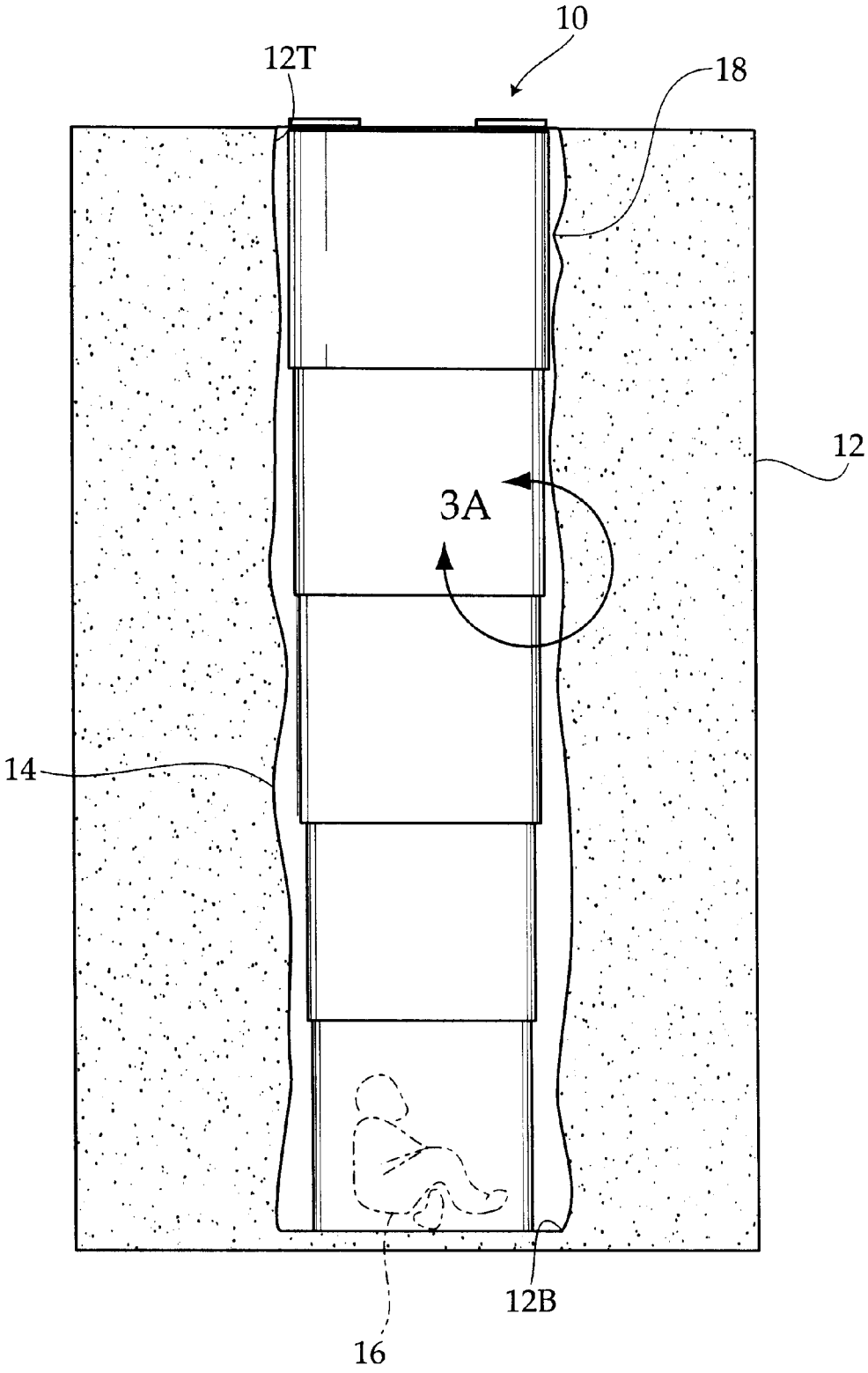
FIG. 3 is a front elevational view of the telescoping tube in place within a shaft.
Figure 3A:
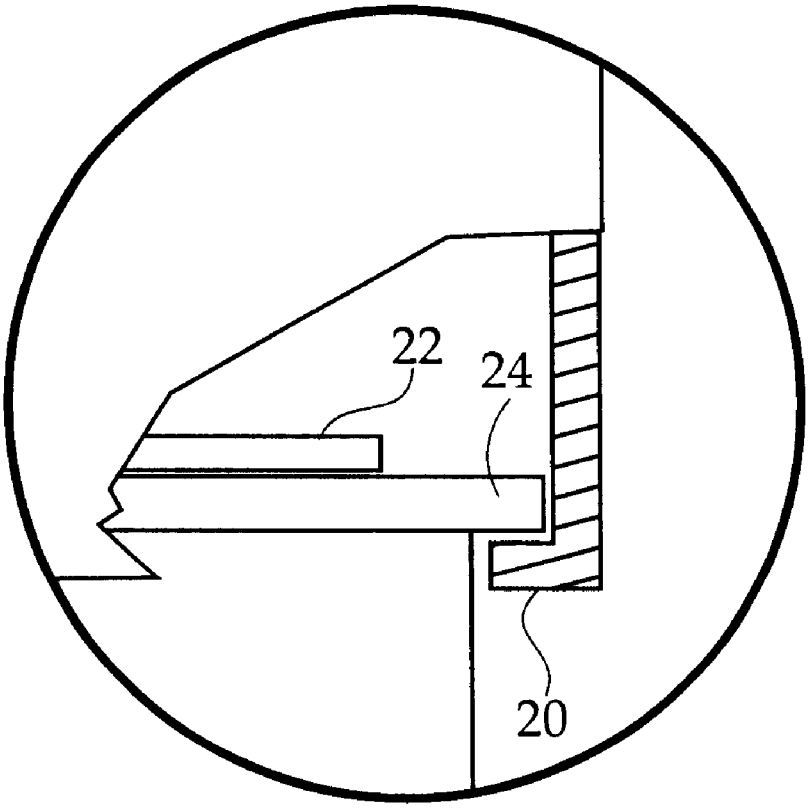
FIG. 3A is an enlarged view of the area indicated by circle 3A in FIG. 3, wherein parts have been broken away to illustrate the interior between the top lid of one of the sections, with the bottom lip and lower ledge of the following section.

In use, the telescoping tube 10 is placed over the opening 12T of the shaft 12 in which the victim 16 is trapped. The individual sections 18 of the tube 10 are then eased downward by engaging the notches 24N of the top lip 24 with a pole until the bottom edge 18B of one of the sections 18 reaches the bottom surface 12B of the shaft, as illustrated in FIG. 3. The victim 16 is then secured within the tube 10, and safe from injury caused by collapsing walls or slippage of dirt, mud or water. Rescuers are then free to save the victim 16 from the shaft 12. After the rescue, the tube 10 is collapsed by pulling the sections 18 upward into the preceding sections 18 until the top lips 24 of the sections 18 are substantially aligned. The tube 10 is then removed from the top opening 12T.

To prevent the tube from collapsing while deployed, the sections 18 are rotated within each other until the top lips 24 of the sections 18 are sandwiched between the bottom rim 20 and lower ledge 22 of the preceding section 18. Before collapsing the tube 10, adjacent sections 18 must be rotated until the top lips 24 clear the lower ledge 22.

In conclusion, herein is presented a telescoping tube for supporting a shaft. The invention is illustrated by example in the drawing figures, and throughout the written description. It should be understood that numerous variations are possible, while adhering to the inventive concept. Such variations are contemplated as being a part of the present invention.

What is claimed is:

1. A telescoping tube for supporting surrounding walls of a shaft, the shaft having a top opening and a bottom surface, comprising:

a plurality of nested telescoping successive sections to be positioned in the shaft, each section having a bore defining an inner wall and an outer wall, a top edge, a bottom edge and a middle portion extending therebetween, each section further having a lower ledge extending inward just above the bottom rim, the bottom rim of one of the sections engaging the top lip of the successive section in order to prevent separation of the sections from each other;

a top lip extending outward from the top edge of each section, the top lip comprises a pair of top lips, said lips extending outward from the outer wall at opposite quadrants along the top edge, wherein a preceding section has a lower ledge extending inward from the inner wall just above the bottom rim, such that another section may be selectively rotated so that one of the top lips is sandwiched between the bottom rim of the preceding section and the lower edge of the preceding section; and a bottom rim extending inward from the bottom edge of each section, the bottom rim of one of the sections selectively engaging the top lip of the successive section to prevent separation of the sections from each other.

2. The telescoping tube as recited in claim 1, wherein the bottom lips further comprise a notch, wherein the notch is used to extend, retract, or rotate the section.

3. A method of preventing injury to a victim trapped in a shaft using a telescoping tube for supporting surrounding walls of the shaft, wherein the shaft has a top opening and a bottom surface, and the telescoping tube comprises a plurality of nested telescoping successive sections, each section having a top edge, a bottom edge, a bottom rim extending inward at the bottom edge, a notch positioned on the bottom rim, comprising the steps of:

placing the collapsed telescoping tube over the top opening of the shaft;

extending the telescoping tube downward through the shaft until the bottom edge of one of the sections rests upon the ground surface of the shaft;

engaging one of the notches on the innermost section with a pole and pushing downward; and urging each section downward until its top lip rests upon the bottom lip of the preceding section.

4. The method of preventing injury to a victim trapped in a shaft as recited in claim 3, wherein with respect to one of the sections, the preceding section has a lower ledge extending inward and located just above the bottom rim, and further comprising the step of:

preventing the tube from collapsing by rotating the one section until its top lip is sandwiched between the bottom rim and lower ledge of the preceding section.

* * * * *